US005188090A

United States Patent [19]

Griggs

[11] Patent Number: 5,188,090

[45] Date of Patent: Feb. 23, 1993

[54] APPARATUS FOR HEATING FLUIDS

[75] Inventor: James L. Griggs, Powder Springs, Ga.

[73] Assignee: Hydro Dynamics, Inc., Cartersville, Ga.

[21] Appl. No.: 682,003

[22] Filed: Apr. 8, 1991

[51] Int. Cl.[5] ..... F24C 9/00

[52] U.S. Cl. ..... 126/247; 122/26

[58] Field of Search ..... 237/1 R, 12.3 R; 126/247; 122/26

[56] References Cited

U.S. PATENT DOCUMENTS

| | | | |
|---|---|---|---|
| 1,758,207 | 5/1930 | Walker . | |
| 2,316,522 | 4/1943 | Loeffler . | |
| 2,991,764 | 7/1961 | French . | |
| 3,508,402 | 4/1970 | Gray . | |
| 3,690,302 | 9/1972 | Rennolds . | |
| 3,720,372 | 3/1973 | Jacobs . | |
| 3,791,349 | 2/1974 | Schaefer . | |
| 4,381,762 | 5/1983 | Ernst | 126/247 X |
| 4,779,575 | 10/1988 | Perkins | 126/247 X |

*Primary Examiner*—Henry A. Bennet
*Attorney, Agent, or Firm*—Pitts and Brittian

[57] ABSTRACT

Devices for heating fluids. The devices employ a cylindrical rotor which features surface irregularities. The rotor rides a shaft which is driven by external power means. Fluid injected into the device is subjected to relative motion between the rotor and the device housing, and exits the device at increased pressure and/or temperature. The device is thermodynamically highly efficient, despite the structural and mechanical simplicity of the rotor and other compounds. Such devices accordingly provide efficient, simply, inexpensive and reliable sources of heated water and other fluids for residential and industrial use.

14 Claims, 4 Drawing Sheets

APPARATUS FOR HEATING FLUIDS

BACKGROUND OF THE INVENTION

The present invention relates to devices containing rotating members for heating fluids.

Various designs exist for devices which use rotors or other rotating members to increase pressure and/or temperature of fluids (including, where desired to convert fluids from the liquidous to gaseous phases). U.S. Pat. No. 3,791,349 issued Feb. 12, 1974 to Schaefer, for instance, discloses an apparatus and method for production of steam and pressure by intentional creation of shock waves in a distended body of water. Various passageways and chambers are employed to create a tortuous path for the fluid and to maximize the water hammer effect.

Other devices which employ rotating members to heat fluids are disclosed in U.S. Pat. No. 3,720,372 issued Mar. 13, 1973 to Jacobs which discloses a turbing type coolant pump driven by an automobile engine to warm engine coolant; U.S. Pat. No. 2,991,764 issued Jul. 11, 1961 which discloses a fluid agitation-type heater; and U.S. Pat. No. 1,758,207 issued May 13, 1930 to Walker which discloses a hydraulic heat generating system that includes a heat generator formed of a vaned rotor and stator acting in concert to heat fluids as they move relative to one another.

These devices employ structurally complex rotors and stators which include vanes or passages for fluid flow, thus resulting in structural complexity, increased manufacturing costs, and increased likelihood of structural failure and consequent higher maintenance costs and reduced reliability.

SUMMARY OF THE INVENTION

Devices according to the present invention for heating fluids contain a cylindrical rotor whose cylindrical surface features a number of irregularities or bores. The rotor rotates within a housing whose interior surface conforms closely to the cylindrical and end surfaces of the rotor. A bearing plate, which serves to mount bearings and seals for the shaft and rotor, abuts each side of the housing. The bearing plates feature hollowed portions which communicate with the void between the housing and rotor. Inlet ports ar formed in the bearing plates to allow fluid to enter the rotor/housing void in the vicinity of the shaft. The housing features one or more exit ports through which fluid at elevated pressure and/or temperature exits the apparatus. The shaft may be driven by electric motor or other motive means, and may be driven directly, geared, powered by pulley or otherwise driven.

According to one aspect of the invention, the rotor devices may be utilized to supply heated water to heat exchangers in HVAC systems and to deenergized hot water heaters in homes, thereby supplanting the requirement for energy input into the hot water heaters and furnace side of the HVAC systems.

It is accordingly a object of the present invention to provide a device for heating fluid in a void located between a rotating rotor and stationary housing, which device is structurally simple and requires reduced manufacturing and maintenance costs.

It is an additional object of the present invention to produce a mechanically elegant and thermodynamically highly efficient means for increasing pressure and/or temperature of fluids such as water (including, where desired, converting fluid from liquid to gas phase).

It is an additional object of the present invention to provide a system for providing heat and hot water to residences and commercial space using devices featuring mechanically driven rotors for heating water.

Other objects, features and advantages of the present invention will become apparent with reference to the remainder of this document.

DETAILED DESCRIPTION OF THE DRAWINGS

Figure 1:
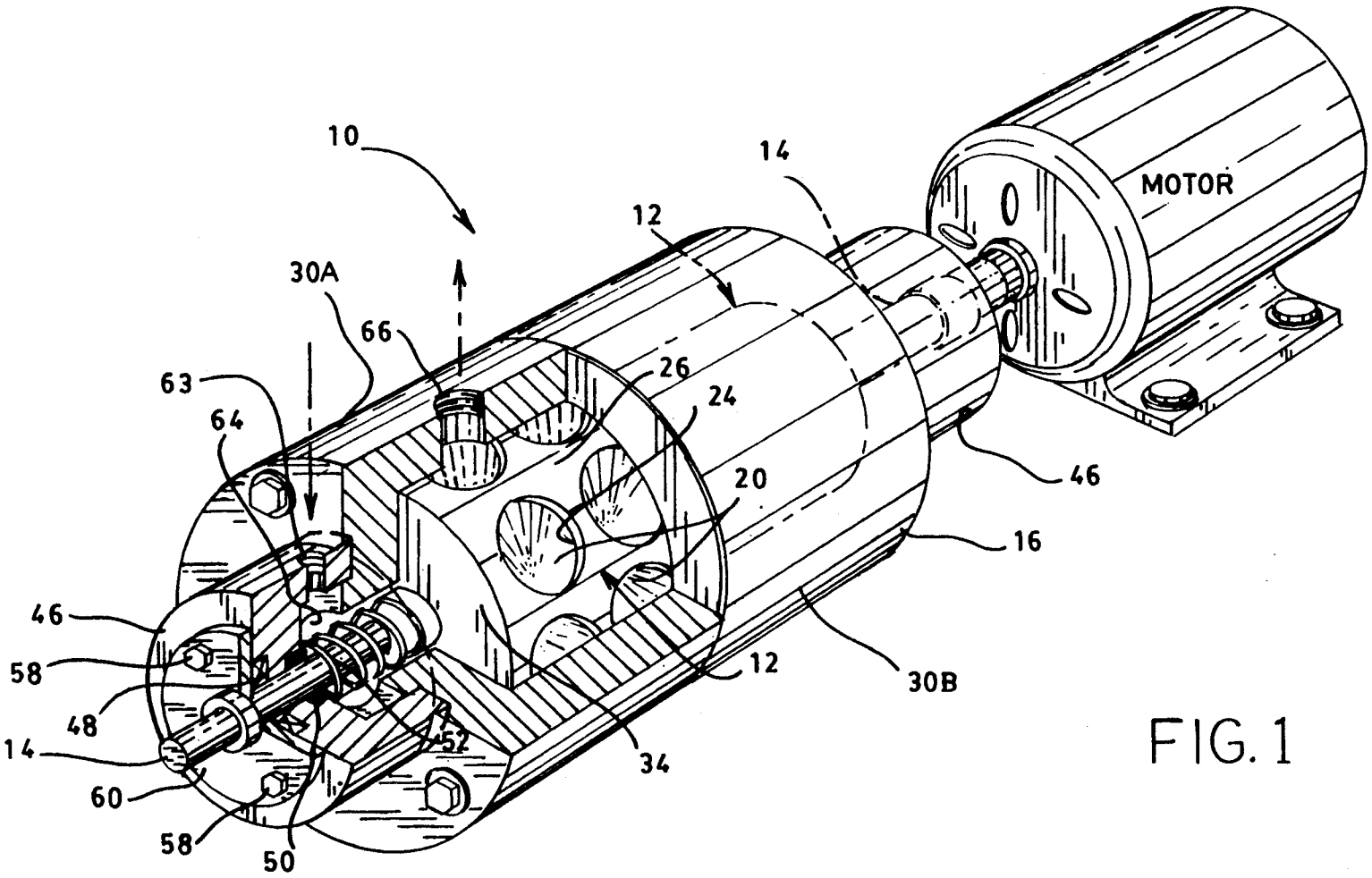
FIG. 1 is a partially cutaway perspective view of a first embodiment of a device according to the present invention.

As shown in FIG. 1, device 10 in briefest terms includes a rotor 12 mounted on a shaft 14, which rotor 12 and shaft 14 rotate within a housing 16. Shaft 14 in the embodiment shown in FIGS. 1 and 2 has a primary diameter of 1¾" and may be formed of forged steel, cast or ductile iron, or other materials as desired. Shaft 14 may be driven by an electric motor or other motive means, and may be driven directly, geared, driven by pulley, or driven as otherwise desired.

Figure 2:
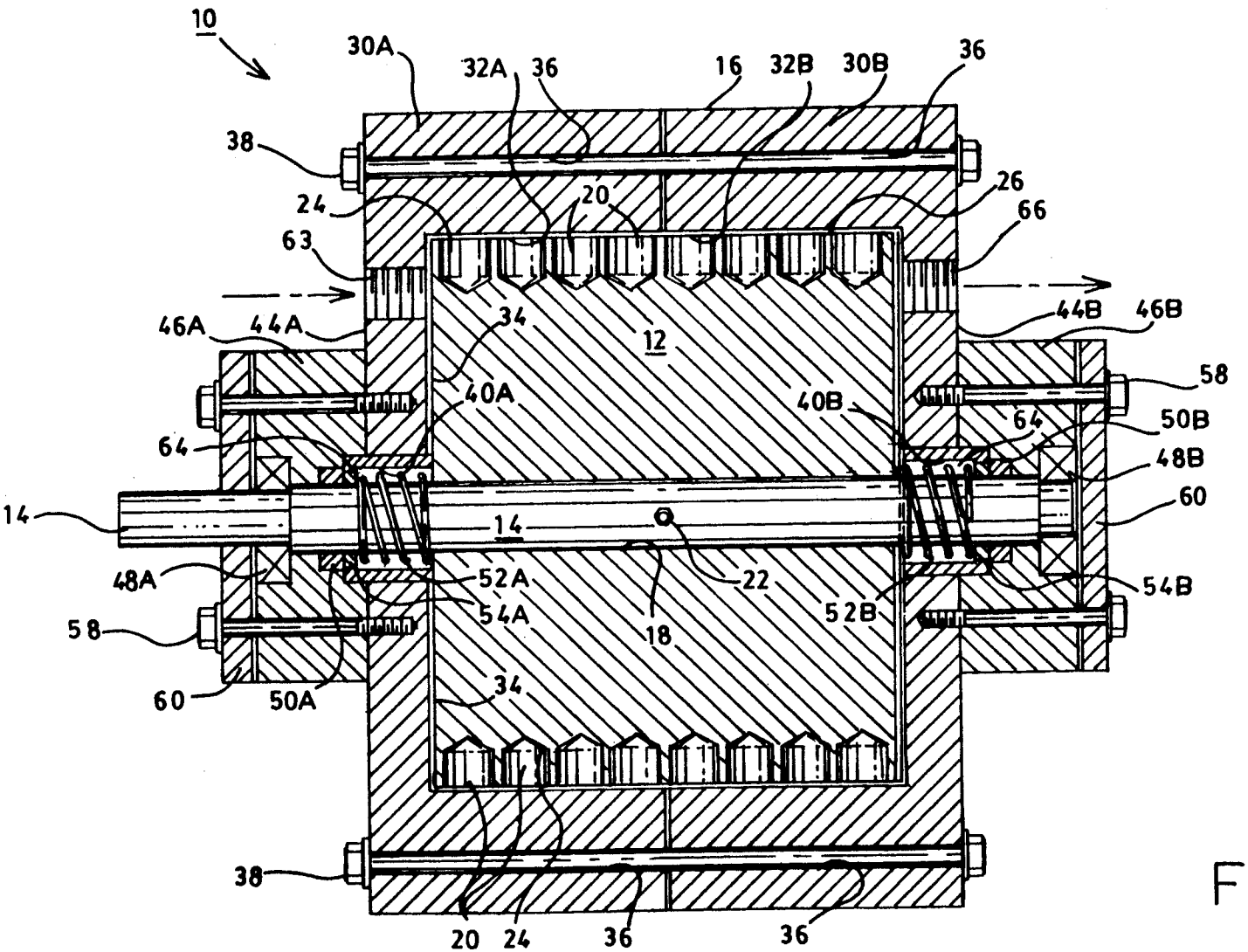
FIG. 2 is a cross-sectional view of a second embodiment of a device according to the present invention.

Attached rigidly to shaft 14 is rotor 12. Rotor 12 may be formed of aluminum, steel, iron or other metal or alloy as appropriate. Rotor 12 is essentially a solid cylinder of material featuring a shaft bore 18 to receive shaft 14, and a number of irregularities 20 in its cylindrical surface. In the embodiment shown in FIGS. 1 and 2, rotor 12 is six inches in diameter and nine inches in length, while in the embodiment shown in FIG. 3 the rotor is ten inches in diameter and four inches in length. Locking pins set screws or other fasteners 22 may be used to fix rotor 12 with respect to shaft 14. In the embodiment shown in FIG. 1, rotor 12 features a plurality of regularly spaced and aligned bores 24 drilled, bored, or otherwise formed in its cylindrical surface 26. Bores 24 may feature countersunk bottoms, as shown in FIG. 2. Bores 24 may also be offset from the radial direction either in a direction to face toward or away from the direction of rotation of rotor 12. In one embodiment of the invention, bores 24 are offset substantially 15 degrees from direction of rotation of rotor 12. Each bore 24 may feature a lip 28 (not shown) where it meets surface 26 of rotor 12, and the lip 28 may be flared or otherwise contoured to form a continuous surface between the surfaces of bores 28 and cylindrical surface 26 of rotor 12. Such flared surfaces are useful for providing areas in which vacuum may be developed as rotor 12 rotates with respect to housing 16. The depth, diameter and orientation of bores 24 may be adjusted in dimension to optimize efficiency and effectiveness of device 10 for heating various fluids, and to optimize operation, efficiency, and effectiveness of device 10 with respect to particular fluid temperatures, pressures and flow rates, as they relate to rotational speed of rotor 12. In a preferred embodiment of the device, the bores 24 are formed radially substantially 18 degrees apart from on another.

In the embodiment shown in FIGS. 1 and 2, housing 16 is formed of two housing bells 30A and 30B which are generally C-shaped in cross section and whose interior surfaces 32A and 32B conform closely to the cylindrical surface 26 and ends 34 of rotor 12. The devices shown in FIGS. 1 and 2 feature a 0.1 inch clearance between rotor 12 and housing 16. Smaller or larger clearances may obviously be provided, once again depending upon the parameters of the fluid involved, the desired flow rate and the rotational speed of rotor 12. Housing bells 30A and 30B may be formed of aluminum, stainless steel or otherwise as desired, and preferably feature a plurality of axially disposed holes 36 through which bolts or other fasteners 38 connect housing bells 30A and 30B in sealing relationship. Each housing bell 30A and 30B also features a axial bore sufficient in diameter to accommodate the shaft 14 together with seals about the shaft, and additionally to permit flow of fluid between the shaft, seals, and housing bell 30A and 30B and bore 40.

The interior surface 32A and 32B of housing bells 30A and 30B may be smooth with no irregularities, or may be serrated, feature holes or bores or other irregularities as desired to increase efficiency and effectiveness of device 10 for particular fluids, flow rates and rotor 12 rotational speeds. In the preferred embodiment, there are no such irregularities.

Connected to an outer end 44A and 44B of each bell 30A and 30B is a bearing plate 46A and 46B. The primary function of bearing plates 46A and 46B is to carry one or more bearings 48A and 48B (roller, ball, or as otherwise desired) which in turn carry shaft 14, and to carry an O-ring 50A and 50B that contacts in sliding relationship a mechanical seal 52A and 52B attached to shaft 14. The seals 52A and 52B acting in combination with the O-rings 50A and 50B prevent or minimize leakage of fluid adjacent to shaft 14 from the device 10. Mechanical seals 52A and 52B are preferably spring-loaded seals, the springs biasing a gland 54A and 54B against O-ring 50A and 50B formed preferably of tungsten carbide. Obviously, other seals and o-rings may be used as desired. One or more bearings 48A and 48B may be used with each bearing plate 46A and 46B to carry shaft 14.

Bearing plates 46A and 46B may be fastened to housing bells 30A and 30B using bolts 58 or as otherwise desired. Preferably disk-shaped retainer plates through which shaft 14 extends may be abutted against end plates 46A and 46B to retain bearings 48A and 48B in place.

In the embodiment shown in FIGS. 1 and 2, a fluid inlet port 63 is drilled or otherwise formed in each bearing plate 46A and 46B or housing 16, and allows fluid to enter device 10 first by entering a chamber or void 64 hollowed within the bearing plate 46A or B, or directly into the space 43 located between rotor 12 and housing 16. Fluid which enters through a bearing plate 46 then flows from the chamber 64 through the axial bore 40A and 40B in housing bell 30A and 30B as rotor 12 rotates within housing 16. The fluid is drawn into the space 43 between rotor 12 and housing 16, where rotation of rotor 12 with respect to interior surface 32A and 32B of housing bells 30A and 30B imparts heat to the fluid.

One or more exhaust ports or bores 66 are formed within one or more of housing bells 30A and 30B for exhaust of fluid and higher pressure and/or temperature. Exhaust ports 66 may be oriented radially or as otherwise desired, and their diameter may be optimized to accommodate various fluids, and particular fluids at various input parameters, flow rates and rotor 12 rotational speeds. Similarly inlet ports 63 may penetrate bearing plates 46A and 46B or housing 16 in an axial direction, or otherwise be oriented and sized as desired to accommodate various fluids and particular fluids at various input parameters, flow rates and rotor 12 rotational speeds.

The device shown in FIGS. 1 and 2, which uses a smaller rotor 12, operates at a higher rotational velocity (on the order of 5000 rpm) than devices 10 with larger rotors 12. Such higher rotational speed involves use of drive pulleys or gears, and thus increased mechanical complexity and lower reliability. Available motors typically operate efficiently in a range of approximately 3450 rpm, which the inventor has found is a comfortable rotational velocity for rotors in the 7.3 to 10 inch diameter range. Devices as shown in FIGS. 1-3 may be comfortably driven using 5 to 7.5 horsepower electric motors.

The device shown in FIGS. 1 and 2 has been operated with ½ inch pipe at 5000 rpm using city water pressure at approximately 75 pounds. Exit temperature at that pressure, with a comfortable flow rate, is approximately 300 F. The device shown in FIGS. 1 and 2 was controlled using a valve at the inlet port 63 and a valve at the exhaust port 66 and by adjusting flow rate of water into the device 10. Preferably, the inlet port 63 valve is set as desired, and the exhaust water temperature is increased by constricting the exhaust port 66 orifice and vice versa. Exhaust pressure is preferably maintained below inlet pressure; otherwise, flow degrades and the rotor 12 simply spins at increased speeds a flow of water in void 43 apparently becomes nearer to laminar.

Figure 3:
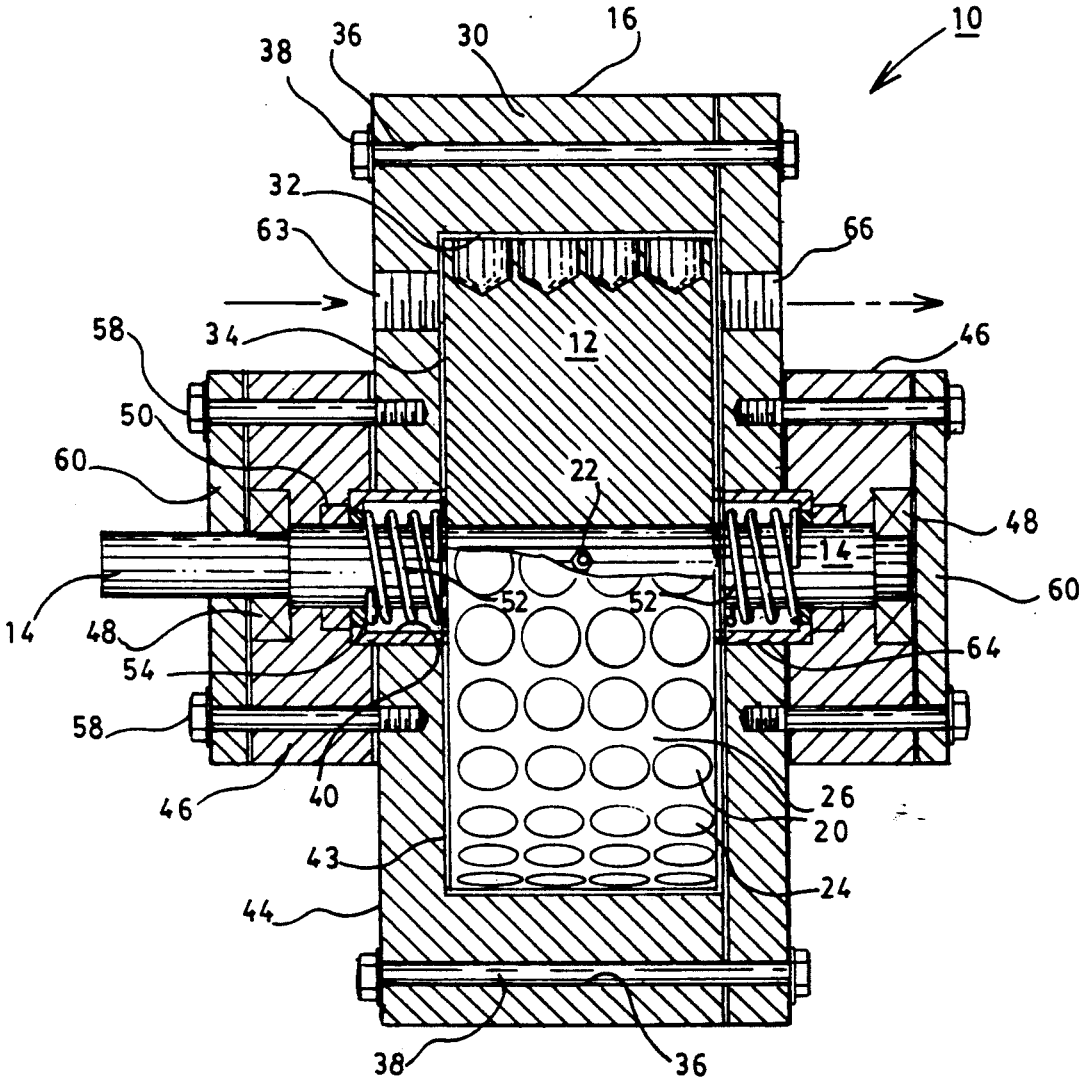
FIG. 3 is a cross-sectional view of a device according to a third embodiment of the present invention.

FIG. 3 shows another embodiment of a device 10 according to the present invention. This device features a rotor 12 having larger diameter and smaller length, and being included in a housing 16 which features only one housing bell 30. The interior surface 32 of housing bell 30 extends the length of rotor 12. A housing plate 68 preferably disk shaped and of diameter similar to the diameter of the housing bell 30 is connected to housing bell 30 in a sealing relationship to form the remaining wall of housing 16. Housing plate 68, as does housing bell 30, features an axial bore 40 sufficient in diameter to accommodate shaft 14, seals 52A and 52B and flow of fluid between voids 64 formed in bearing plates 46A and 46B. This embodiment accommodates reduced fluid flow and is preferred for applications such as residential heating. The inlet port 63 of this device is preferably through housing 16, as is the exhaust port 66, but may be through bearing plates 46 as well.

The device 10 shown in FIG. 3 is preferably operated with ¾ inch copper or galvanized pipe at approximately 3450 rpm, but may be operated at any other desired speed. At an inlet pressure of approximately 65 pounds and exhaust pressure of approximately 50 pounds, the outlet temperature is in the range of approximately 300 F.

Figure 4:
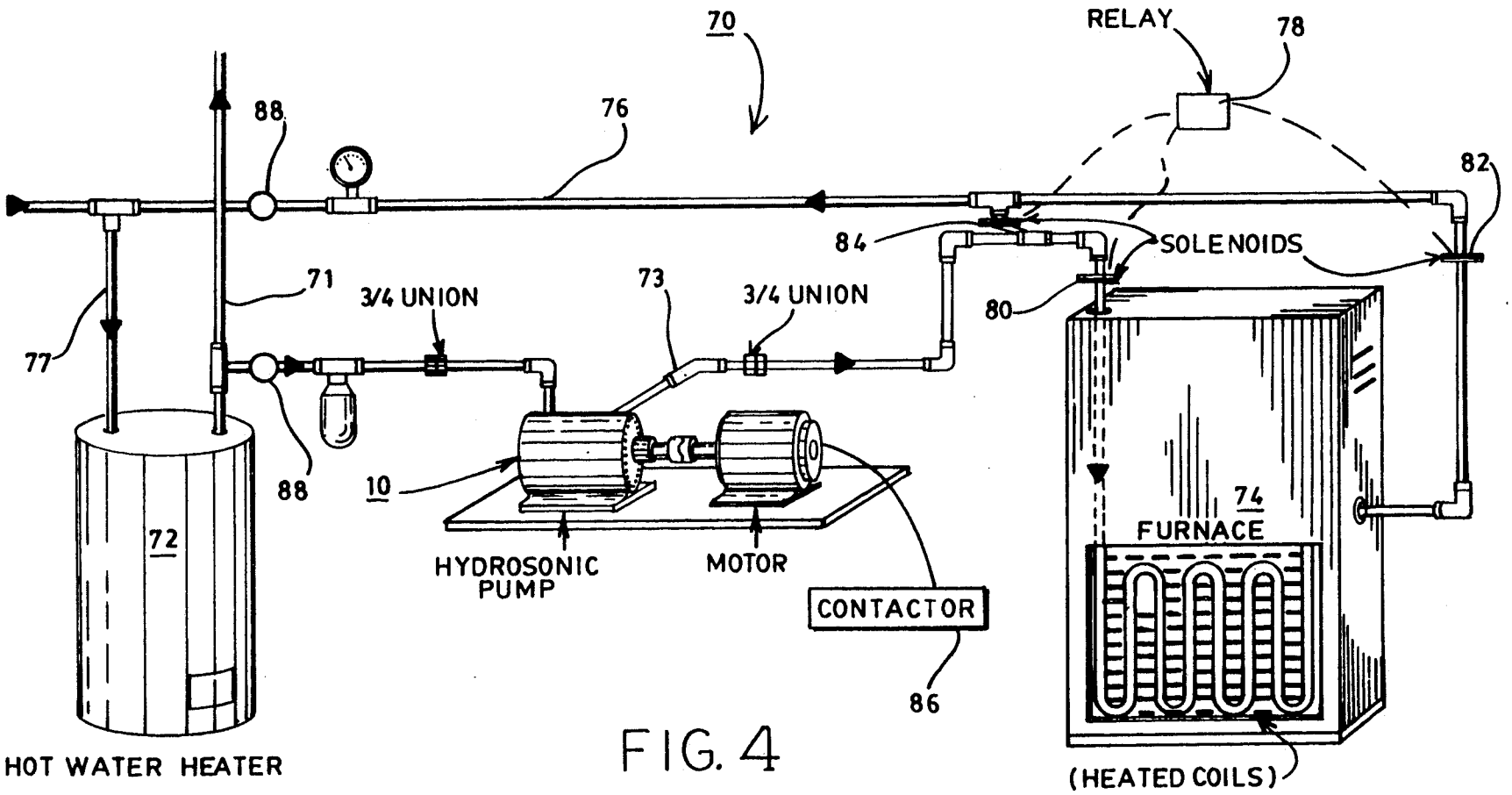
FIG. 4 is a schematic view of a residential heating system according to the present invention.

FIG. 4 shows a residential heating system 70 according to the present invention. The inlet side of device 10 is connected to hot water line 71 of (deactivated) hot water heater 72. Exhaust of device 10 is connected to exhaust line 73 which in turn is connected to the furnace or HVAC heat exchanger 74 and a return line 76 to cold water supply line 77 of hot water heater 72. The device 10 according to one embodiment of such a system features a rotor 12 having a diameter of 8 inches. A heat exchanger inlet solenoid valve 80 controls flow of water from device 10 to heat exchanger 74, while a heat exchanger exhaust solenoid valve 82 controls flow of water from heat exchanger 74 to return line 76. A third solenoid valve, a heat exchanger by-pass solenoid valve 84, when open, allows water to flow directly from device 10 to return line 76, bypassing heat exchanger 74. Heat exchanger valves 80 and 82 may be connected to the normally closed side of a ten amp or other appropriate relay 78, and the by-pass valve 84 is connected to the normally open side of the relay. The relay is then connected to the air conditioning side of the home heating thermostat, so that the by-pass valve 84 is open and the heat exchanger valves 80 and 82 are closed when the home owner enables the air conditioning and turns off the heat. A contactor 86 is connected to the thermostat in the hot water heater and the home heating thermostat so that actuation of either thermostat enables contactor 8 to actuate the motor driving device 10. (In gas water heaters, the temperature switch may be included in the line to replace the normal thermalcouple.)

The hot water heater 72 is turned off and used as a reservoir in this system to contain water heated by device 10. The device 10 is operated to heat the water to approximately 180°-190° F., so that water returning to hot water heater 72 reservoir directly via return line 76 is at approximately that temperature, while water returning via heat exchanger 74, which experiences approximately 40° temperature loss, returns to the reservoir at approximately 150° F. Cutoff valves 88 allow the device 10 and heat exchanger 74 to be isolated when desired for maintenance and repair.

The foregoing is provided for purposes of illustration and explanation of preferred embodiments of the present invention. Modifications may be made to the disclosed embodiments without departing from the scope or spirit of the invention.

What is claimed is:

1. Apparatus for converting energy, comprising:

(a) a shaft for connection to a motive means;

(b) a cylindrical rotor rigidly connected to the shaft, the cylindrical surface of the rotor featuring a plurality of bores whose depth exceeds their diameter;

(c) a pair of seals, each attached to the shaft on opposite sides of the rotor;

(d) a housing bell surrounding the cylindrical surface and one end surface of the rotor, the housing bell generally C-shaped in axial cross section, having an interior surface which conforms closely with the cylindrical and end surfaces of the rotor, and having an axial bore sufficient in diameter to accommodate the shaft and one of the seals with additional space for fluid flow;

(e) a disc shaped housing plate connected to the housing bell in sealing relationship to complete a housing surrounding the rotor, having an interior surface conforming closely with the end surface of the rotor, and having an axial bore sufficient in diameter to accommodate the shaft and one of the seals with additional space for fluid flow;

(f) a first bearing plate connected to the housing bell, featuring a bore adapted in size to accommodate the shaft, a seated O-ring against which one of the seals abuts, a bearing for supporting the shaft, and a hollowed portion adapted in size to accommodate the shaft and one of the seals with additional space for fluid flow;

(g) a second bearing plate connected to the endplate, featuring a bore adapted in size to accommodate the shaft, a seated 0-ring against which one of the seals abuts, a bearing for supporting the shaft, and a hollowed portion adapted in size to accommodate the shaft and one of the seals with additional space for fluid flow;

(h) at least one inlet port to allow flow of fluid into the apparatus; and (i) at least one exit port formed in the housing to allow exhaust of fluid which has been heated by the rotating shaft and rotor acting in concert with the stationary housing and bearing plates.

2. The apparatus of claim 1 in which the bores are oriented radially in the rotor.

3. The apparatus of claim 1 including one inlet port, which inlet port penetrates the housing.

4. The apparatus of claim 1 including one inlet port, which inlet port penetrates a bearing plate.

5. The apparatus of claim 1 including one exhaust port.

6. The apparatus of claim 1 in which the housing comprises an interior surface which includes no irregularities.

7. The apparatus of claim 1 in which the housing comprises an interior surface which includes irregularities.

8. Apparatus for converting energy, comprising:

(a) a shaft for connection to a motive means;

(b) a cylindrical rotor rigidly connected to the shaft, the cylindrical surface of the rotor featuring a plurality of bores whose depth exceeds their diameter;

(c) a pair of seals, each attached to the shaft on opposite sides of the rotor;

(d) a pair of housing bells, each surrounding a portion of the cylindrical surface and one end surface of the rotor the housing bells generally C-shaped in axial cross section, having an interior surface which conforms closely with the cylindrical and end surfaces of the rotor, and having an axial bore sufficient in diameter to accommodate the shaft and one of the seals with additional space for fluid flow;

(e) a pair of bearing plates, each connected to one of the housing bells, each featuring a bore adapted in size to accommodate the shaft, a seated O-ring against which one of the seals abuts, a bearing for supporting the shaft, and a hollowed portion adapted in size to accommodate the shaft and one of the seals with additional space for fluid flow;

(f) at least one inlet port to allow flow of fluid into the apparatus; and (g) at least one exit port formed in the housing to allow exhaust of fluid which has been heated by the rotating shaft and rotor acting in concert with the stationary housing and bearing plates.

9. The apparatus of claim 8 in which the bores are oriented radially in the rotor.

10. The apparatus of claim 8 including one inlet port, which inlet port penetrates the housing.

11. The apparatus of claim 8 including one inlet port, which inlet port penetrates a bearing plate.

12. The apparatus of claim 8 including one exhaust port.

13. The apparatus of claim 8 in which the housing comprises an interior surface which includes no irregularities.

14. The apparatus of claim 8 in which the housing comprises an interior surface which includes irregularities.

* * * * *